US011089864B2

(12) United States Patent
Davidsen

(10) Patent No.: US 11,089,864 B2
(45) Date of Patent: Aug. 17, 2021

(54) FRAME FOR A TABLE OR DESK

(71) Applicant: DewertOkin GmbH, Kirchlengern (DE)

(72) Inventor: Rene Davidsen, Morud (DK)

(73) Assignee: DewertOkin Technology Group Co., Ltd., Jiaxing (CN)

( * ) Notice: Subject to any disclaimer, the term of this patent is extended or adjusted under 35 U.S.C. 154(b) by 0 days.

(21) Appl. No.: 15/565,941

(22) PCT Filed: Apr. 12, 2016

(86) PCT No.: PCT/EP2016/058029
§ 371 (c)(1),
(2) Date: Oct. 12, 2017

(87) PCT Pub. No.: WO2016/166107
PCT Pub. Date: Oct. 20, 2016

(65) Prior Publication Data

US 2018/0103753 A1 Apr. 19, 2018

(30) Foreign Application Priority Data

Apr. 16, 2015 (DE) ..... 10 2015 105 827.8

(51) Int. Cl.
*A47B 11/00* (2006.01)
*A47B 13/00* (2006.01)
(Continued)

(52) U.S. Cl.
CPC ..... *A47B 13/003* (2013.01); *A47B 1/08* (2013.01); *A47B 9/20* (2013.01); *A47B 9/00* (2013.01);
(Continued)

(58) Field of Classification Search
CPC ..... A47B 13/003; A47B 1/08; A47B 9/20; A47B 1/00; A47B 1/06; A47B 13/081
(Continued)

(56) References Cited

U.S. PATENT DOCUMENTS 2,045,942 A * 6/1936 Brody ..... A47B 45/00 211/182
3,912,210 A * 10/1975 von Bohr ..... A47B 13/06 248/188.1
(Continued)

FOREIGN PATENT DOCUMENTS

CA 2823471 A1 * 2/2015 ..... A47B 1/08
CN 1348337 A 5/2002
(Continued)

OTHER PUBLICATIONS

Int'l Search Report dated Jul. 13, 2016 in Int'l Application No. PCT/EP2016/058029.
(Continued)

*Primary Examiner* — Todd M Epps
(74) *Attorney, Agent, or Firm* — Panitch Schwarze Belisario & Nadel LLP

(57) ABSTRACT

The invention relates to a frame for supporting a top 4, 12 of a table or desk at a working height, said frame being designed for fastening legs 6, 9, in particular for height-adjustable legs 6, 8 of a desk. In order to reduce the storage costs for different table or desk sizes, the frame has a movable, in particular longitudinally movable design.

5 Claims, 5 Drawing Sheets

(51) Int. Cl.
*A47B 1/08* (2006.01)
*A47B 9/20* (2006.01)
*A47B 9/00* (2006.01)

(52) U.S. Cl.
CPC . *A47B 2013/006* (2013.01); *A47B 2200/0015* (2013.01)

(58) Field of Classification Search
USPC ..... 248/188; 108/137, 186, 59, 65, 67, 69, 108/143; 211/175, 182, 123
See application file for complete search history.

(56) References Cited

U.S. PATENT DOCUMENTS

| | | | | |
|---|---|---|---|---|
| 6,263,809 | B1 * | 7/2001 | Wolters | A47B 9/00 108/147 |
| 7,934,459 | B2 * | 5/2011 | Frazier | A47B 13/088 108/64 |
| 8,348,071 | B1 * | 1/2013 | Janlert | F16M 5/00 211/175 |
| 8,967,054 | B2 * | 3/2015 | Henriott | A47B 13/003 108/50.02 |
| 9,173,481 | B2 * | 11/2015 | Haansbæk | A47B 13/021 |
| 9,271,567 | B2 * | 3/2016 | Wu | A47B 1/08 |
| 2015/0282605 | A1 * | 10/2015 | Wu | A47B 1/08 248/188.2 |

FOREIGN PATENT DOCUMENTS

| | | | | |
|---|---|---|---|---|
| CN | 200962970 | Y | 10/2007 | |
| DE | 29800529 | U1 | 3/1998 | |
| DE | 29800529 | U1 * | 5/1998 | A47B 1/08 |
| DE | 202011050924 | * | 11/2011 | |
| DE | 202011050924 | U1 * | 11/2011 | B60N 3/001 |
| DE | 202011050924 | U1 | 11/2011 | |
| EP | 0956791 | A2 | 11/1999 | |
| FR | 1291776 | A | 4/1962 | |
| GB | 1385736 | A | 2/1975 | |

OTHER PUBLICATIONS

Written Opinion dated Jul. 13, 2016 in Int'l Application No. PCT/EP2016/058029.
Int'l Preliminary Report on Patentability dated Oct. 26, 2017 in Int'l Application No. PCT/EP2016/058029.
Office Action dated Apr. 9, 2020 in Chinese Application No. 201680022334.6.

* cited by examiner

FRAME FOR A TABLE OR DESK

CROSS-REFERENCE TO RELATED APPLICATIONS

This application is a Section 371 of International Application No. PCT/EP2016/058029, filed Apr. 12, 2016, which was published in the German language on Oct. 20, 2016, under International Publication No. WO 2016/166107 A1, the disclosure of which is incorporated herein by reference.

BACKGROUND OF THE INVENTION

The invention concerns a frame for supporting a top of a table or desk at a working height, which is designed for fixing legs, in particular for height-adjustable legs of an office desk.

Known table or desk frames comprise a plurality of metal profile members which are welded together to form a preferably self-contained profile member frame which forms a desk or table plane extending substantially horizontally in the installation position and on which a desk or table top is fixed at the top side and to which moreover there are fixed legs which in the installation position extend vertically and thus transversely relative to the table or desk plane and which support the table or desk in relation to the ground, therefore extending between the frame and the ground. Depending on the respective fixing location of the vertically extending leg portion on the upright leg the table legs can either be of a T-shaped or L-shaped configuration in order to provide for various installation situations and to improve the tipping stability when major table or desk loads are involved.

The tops of office desks are usually of a width or depth of between 1000 and 1200 mm and are of different lengths, preferably 2000 to 2500 mm. As the frames are usually set back in relation to the top, the outside dimensions of the frames are correspondingly smaller in that respect.

In the case of modern tables or desks the legs are preferably in the form of height-adjustable lift columns with 2-3 telescopic elements which are telescopically displaceable into each other. Height adjustment is normally effected using an electric motor with a worm gear which engages by way of a jaw coupling into a spindle which is installed in the lift columns.

Such a desk or table or frame for same must provide a defined degree of transverse and longitudinal stiffness for the table or desk, which are specified in EN 527-2 and 527-3, in the specifications of the Office Equipment Standards Committee in DIN Technical Report No. 147 and in other applicable international standards. This sets out a testing method for work tables and office cabinets for determining the strength and the durability of moveable parts.

In known desk frames, for example DE 298 00 529 U1, the telescopic elements of the height-adjustable lift columns are connected together by transverse members which are disposed in the space beneath the desk top, for example at knee height, and limit the leg room of the user.

Disadvantages in the State of the Art

The high stockkeeping costs for different table and desk variants and sizes are disadvantageous because they usually have to be welded in a prefabricated condition and in that respect a relatively large amount of storage space is required for table or desk frames of different sizes, for tops of differing sizes.

Technical Problem/Object

Taking that state of the art as the basic starting point, the object of the invention is to at least partially avoid those disadvantages and to provide a table or desk frame which at least partially avoids the disadvantages set forth in the opening part of this specification and in particular reduces the stockkeeping costs for different sizes and variants.

Invention

In the case of a table or desk frame of the kind set forth in the opening part of this specification that object is already attained in that the frame is adapted to be displaceable, in particular longitudinally displaceable. In that respect the frame is preferably displaceable in telescopic fashion, including correspondingly designed profile members, wherein at least one first profile member is adapted for longitudinally displaceably receiving at least one further profile member.

BRIEF SUMMARY OF THE INVENTION

The frame according to an embodiment of the invention is preferably designed to be telescopically displaceable, including profile members which are of a corresponding or complementary design, including at least one first receiving profile member for longitudinally displaceably receiving at least one further insert profile member. It is to be taken into consideration, however, that the invention is not limited to a profile arrangement with only two relatively moveable profile members, that is to say three or more profile members can certainly be used.

When using a receiving profile member and at least one insert profile member which is displaceable into same it has been found to be desirable, to implement simultaneous fixing of the profile members to the underside of a desk or table top and relative fixing of the two profile members in the desired target position, that both profile members have openings which are arranged at given, preferably recurring spacings, and which in addition are so matched in terms of size that a screw or a fixing element can be inserted through them.

As previously mentioned the frame is preferably designed for longitudinal adjustment and therefore includes longitudinally adjustable longitudinal profile members which are preferably adjustable in mutually displaced relationship, that is to say it does not include separation planes extending along a common plane. The frame also includes one or more transverse bearers which extend perpendicularly to the longitudinal bearers, generally parallel to the narrow sides of the table or desk top. It is in accordance with an embodiment of the invention that the transverse bearers are also designed to be longitudinally adjustable, although that is usually not the case for reasons of stability. The transverse bearers can be disposed as head profile members at the ends of the longitudinal bearers. Those transverse bearers can be for example simple angular or right-angled profile members. It will be appreciated that other configurations are possible, for example of a width which increases from the ends of the transverse bearer to the center thereof, or in particular in the form of head profile members involving an aesthetic or identifying configuration of the outsides, for example with two-dimensional decorations or corporate logos. The transverse bearers can also be asymmetrically designed and/or assembled, if for example the lift columns are not oriented on the longitudinal center line of the desk or table top.

In general the frame according to the invention includes two longitudinally adjustable longitudinal profile members which for example with the transverse bearers or head profile members can form a rectangular frame. It is, however, certainly also possible to use only one longitudinal profile member or a plurality, for example three or four, in the frame according to the invention.

This modular structure of the frame according to the invention made up of individual component parts permits both the implementation of a multiplicity of different frames and also compact packaging of the individual parts prior to assembly.

In the particularly stable embodiment the profile members of the desk or table frame are in the form of closed quadrangular profile members, particularly preferably involving a diameter of 40×40 mm of the receiving profile member bodies into which insert profile members of a size of 35×35 mm can be longitudinally displaceably inserted. A wall thickness of 2 mm using metal profile members has been found to be particularly appropriate.

The particular advantage of this configuration according to the invention is that the table or desk frame in the condition of being pushed together, that is to say in the condition of being completely compressed or pushed into each other, is of a size for being transported on a standard Euro-pallet of a length of 120 cm and it is only upon assembly to constitute the frame for supporting the top that it is extended to the respectively required length.

The fixing means for fixing the frame to the underside of the top are preferably so designed that, besides that fixing, at the same time they also implement fixing of the frame in the target position. Preferably that is effected by way of screws which can be introduced into openings in the frame, that is to say openings which in given positions are so aligned that the fixing screws or fixing means can be fitted through same.

For fixing to the top and for fixing the frame in the respectively optimum target position, the table or desk frame is preferably adapted for fitting the fixing means or screws in particular through the profile members into the underside of the top.

The individual parts of the frame preferably comprise metal profile members, in particular involving a material thickness of 1.5 to 2 mm. The frame is in the form of a self-supporting and inherently stiff frame which defines a support surface for the table or desk top, preferably extending horizontally.

The frame according to an embodiment of the invention is distinguished by excellent stability. In contrast to known frames therefore it does not require a so-called transverse beam member, that is to say it does not need a stabilizing connection in respect of the table legs or the lower portions of the lift columns, which would limit the leg room of the user with undesirable consequences. In the practical configuration the tables or desks with the frame according to an embodiment of the invention exhibited excellent results for deflection and oscillation damping in the pendulum impact hammer test in accordance with the above-mentioned Standards.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

A preferred embodiment of the invention is illustrated by way of example and in non-limiting fashion in the drawings and is described in greater detail hereinafter. In the following detailed description attention is directed to the accompanying drawings which form part thereof and in which specific embodiments in which the invention can be carried into effect are shown for illustration purposes. In this respect directional terminology like for example "up", "down", "forward", "rearward", "front", "rear" and so forth are used in relation to the orientation of the described FIGS. As components of embodiments can be positioned in a number of different orientations the directional terminology serves for illustration purposes and is in no way limiting. It will be appreciated that other configurations can be used and structural or logical modifications can be made without thereby departing from the scope of the present invention. The following detailed description is not to be interpreted in a restrictive fashion. In accordance with this description the terms "connected", "joined" and "integrated" are used to describe both a direct and also an indirect connection, a direct or indirect join and direct or indirect integration. Identical or similar elements are denoted by identical reference numerals in the FIGS. insofar as this is appropriate. The views in the FIGS. are substantially true to scale. To illustrate details, however, certain regions may be illustrated on a disproportionately large scale as will be apparent to the man skilled in the art. In addition the drawings can be strikingly simplified and may not contain every detail which is possibly to be found in a practical implementation.

In the drawings:

FIG. 1 shows a perspective view of an office desk with a telescopic desk frame according to the invention in a first installation situation for a short desk top;

FIG. 2 shows a perspective view of an office desk with a telescopic desk frame according to the invention in a second installation situation for a long desk top;

FIG. 3 shows an exploded view of another embodiment of the desk frame according to the invention, FIG. 4 shows the desk frame of FIG. 3, assembled; and FIG. 5 shows the desk frame of FIG. 4 in a modified assembly situation.

DETAILED DESCRIPTION OF THE INVENTION

Figure 1:
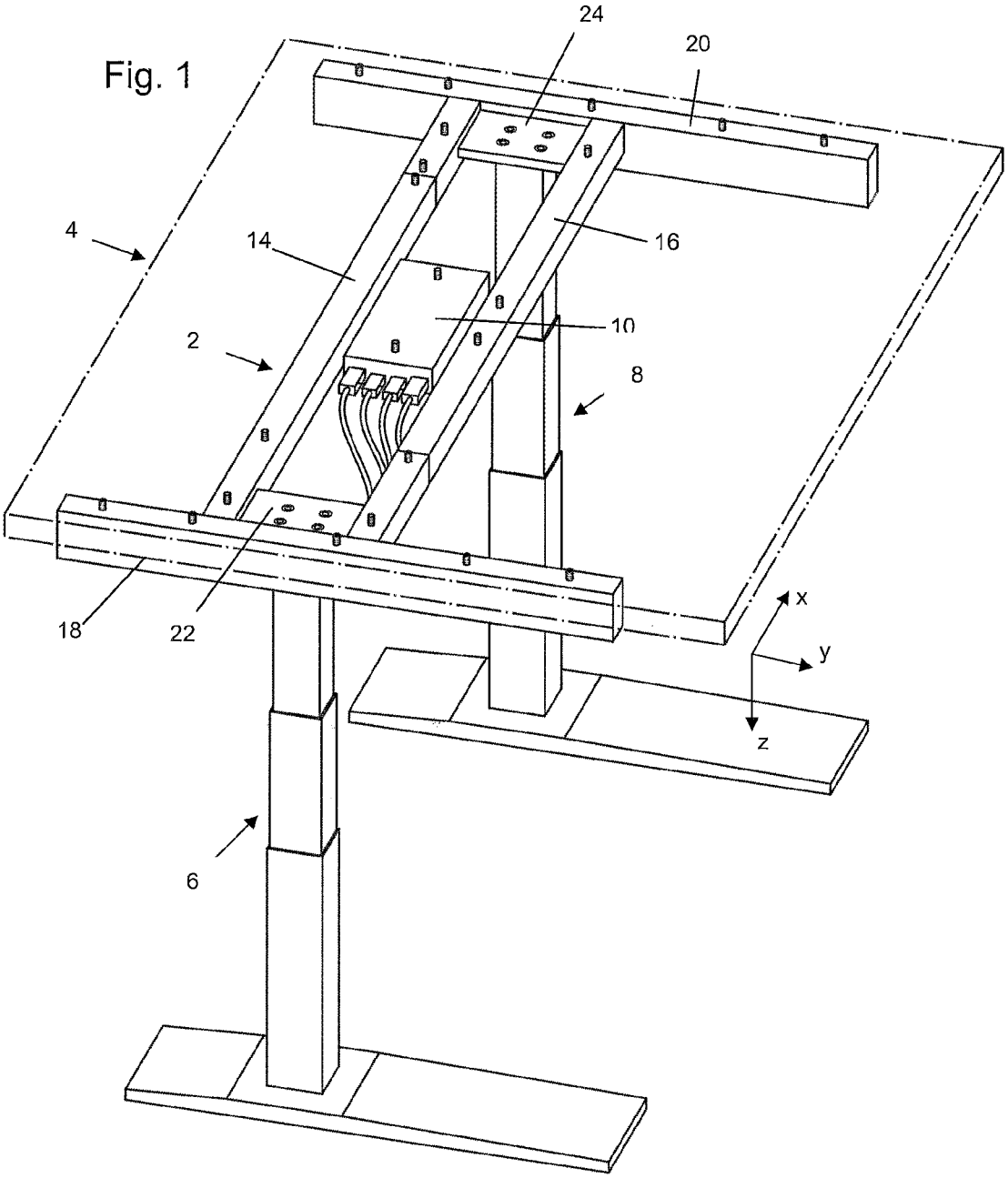

Parts which are the same or have the same effect are provided with the same reference numerals.

FIG. 1 shows a Cartesian coordinate system to clearly illustrate the various directions. Accordingly, the longitudinal direction extends along the X-axis, the transverse direction extends along the Y-axis and height adjustment is effected along the Z-axis.

The present embodiment includes a telescopic desk frame 2 which is longitudinally adjustable on the longitudinal axis of the desk.

The telescopic desk frame 2 carries a short table top 4 which is shown in broken line, of a length of about 1.2 m. Fixed to the telescopic frame 2 at the two ends thereof are desk legs which can be extended in height-adjustable fashion, that is to say also telescopically, and which are adjustable steplessly from a lowered position at a working height of about 60 cm above the floor to a raised position at a working height of about 1.2 m, which is preferably effected by way of electric motors which are arranged in the columns of the desk legs 6, 8 and which respectively drive a spindle received in the desk legs by way of a jaw coupling.

Figure 2:
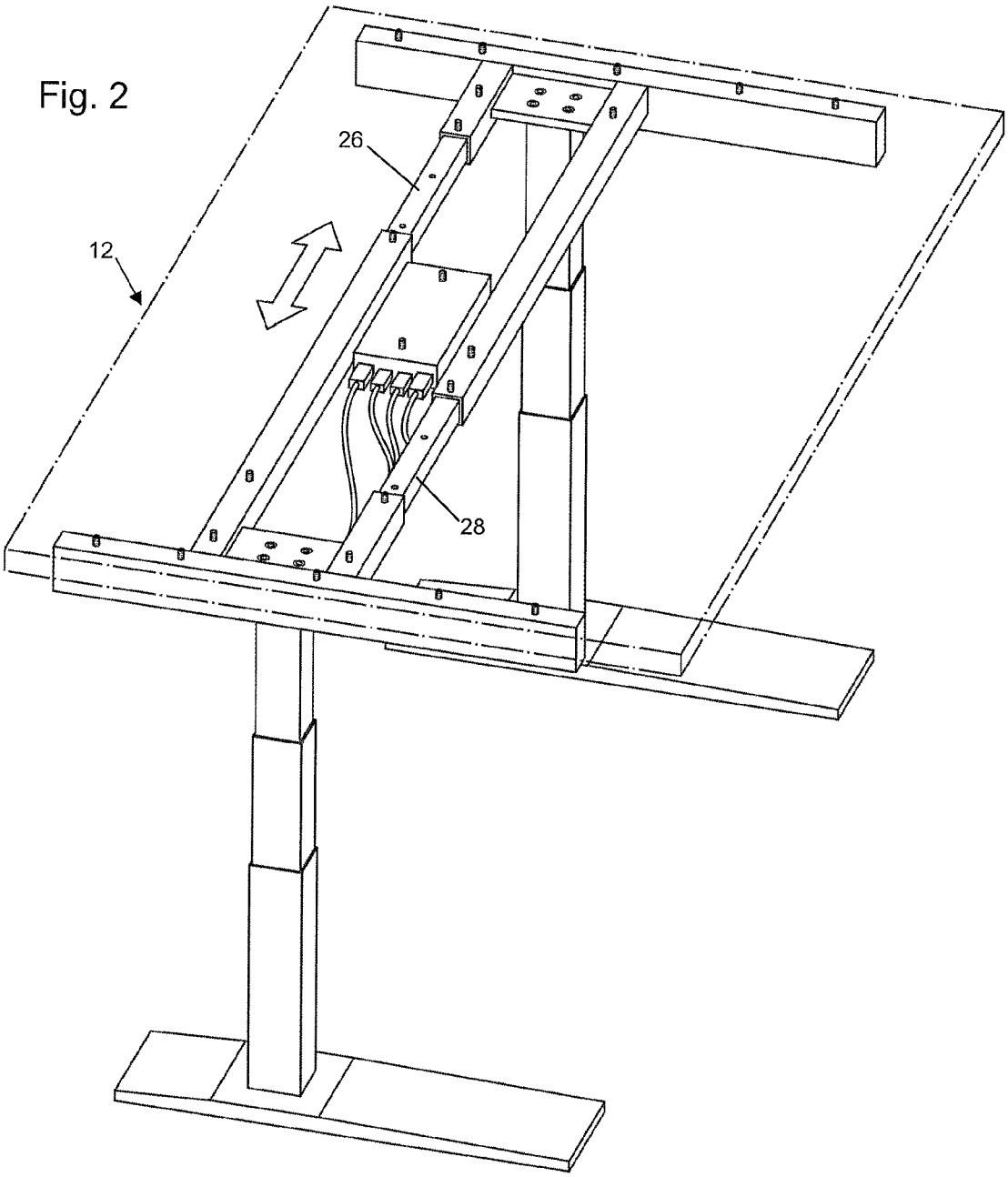

FIG. 1 shows the telescopic desk frame 2 in the position of being pushed together to the maximum extent for a relatively short desk top 4 of a length of about 1.2 m. FIG. 2 in contrast shows the same telescopic frame 2 in an extended position for a desk top 12 which is substantially longer in relation to the embodiment of FIG. 1, being about 2 m in length.

It can be clearly seen that the telescopic frame 2 includes two longitudinal profile members 14, 16 which are spaced relative to each other at a spacing of about 50 cm and which can be telescopically extended and which at the ends are connected together to form a closed frame by way of head profile members (transverse bearers) 18, 20 extending transversely to the longitudinal axis, wherein the top sides of the profile members 14, 16, 18, 20 define a support surface for the desk top 4.

In a preferred configuration, the head profile members 18, 20 are initially loose and are moved for assembly to the telescopic desk frame 2. Firstly the telescopic desk frame 2 is screwed to the desk top 4, 12. Then the head profile members 18, 20 are brought to the telescopic desk frame 2 and also screwed to the desk top 4, 12. In that case the telescopic desk frame 2 is additionally braced in relation to the desk top so that the desk acquires still more stability.

Arranged at the ends in the intermediate space between the longitudinal profile members 14, 16 and the head profile members 18, 20 are peripherally enclosed assembly plates 22, 24 having four through holes for fixing bolts for the desk legs 6, 8. Those assembly plates 22, 24 are preferably welded between the longitudinal profile members 14, 16 and to the head profile members 18, 20.

As an alternative to the illustrated embodiment, it is also possible to use lift columns in which the electric motor is disposed in a motor casing fixed at the upper end of the lift columns and then acts from there on a spindle in the lift columns for example by way of a jaw coupling, whereby the spindle is adjusted. In that case the motor casing can be fixed to the assembly plate or also directly to the longitudinal profile members 14, 16.

Synchronous control of the electric motors for adjustment of the desk height is effected by way of a control box 10 arranged in the center between the spaced longitudinal profile members 14, 16 for accommodating a circuit which is connected by way of cables to the two electric motors in the desk legs 6, 8 and a switch (not shown).

Arranged in the top sides of the profile members of the telescopic desk frame are a plurality of pins which are spaced from each other and which in the installation position engage into corresponding holes on the underside of the desk top 4 for fixing the position thereof. Besides those pins, for fixing in the desired target position, screws can be screwed through openings which are oriented in aligned relationship through the profile members into the underside of the desk top.

As mentioned above the telescopic desk frame 2, in relation to the position of being completely pushed together as shown in FIG. 1, is illustrated in FIG. 2 in the further extended position in which the longitudinal profile members 14, 16 are spaced from each other and the insert profile members 26, 28 which are received therein connect the longitudinal profile members 14, 16 together, wherein separation of the longitudinal profile members 14, 16 is effected in different planes. In this extended position the telescopic desk frame 2 is optimized for the long desk top 12 of a length of about 2 meters.

Figure 3:
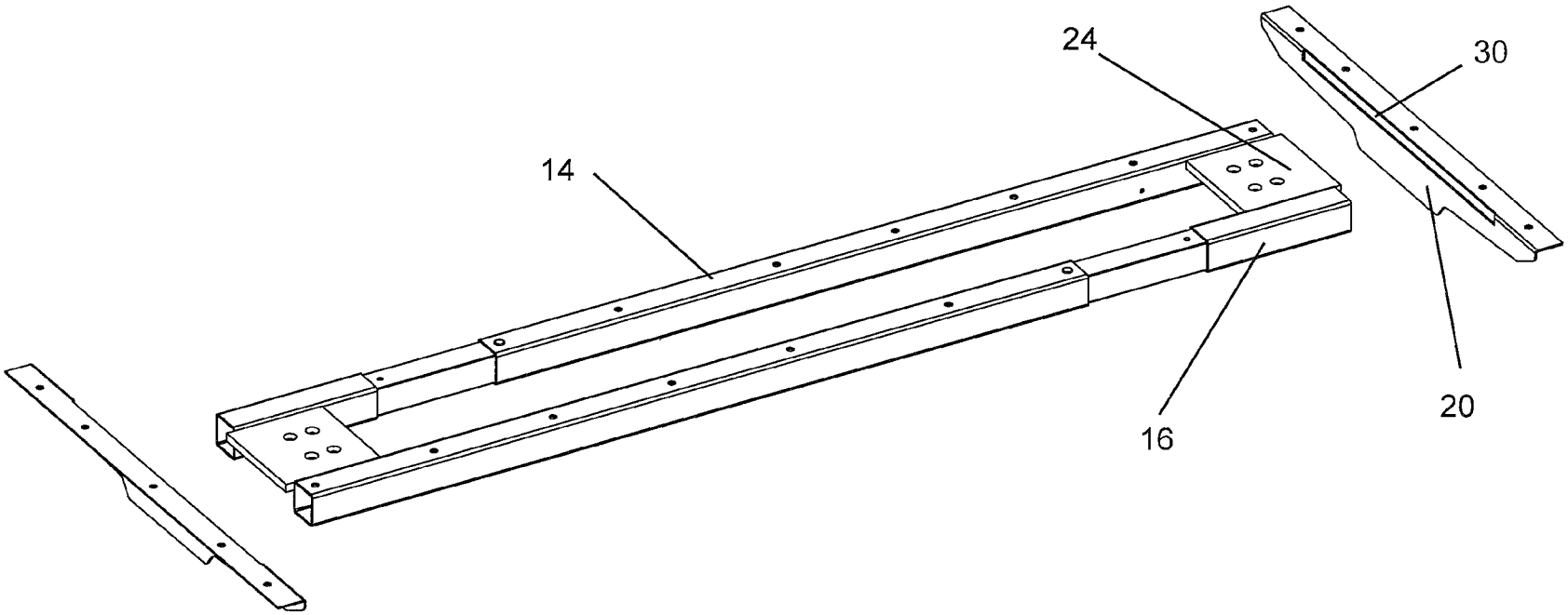

FIG. 3 shows a further embodiment of a desk frame according to the invention in respect of its individual parts. The longitudinal profile members 14, 16 are connected, for example welded, at the right-hand end to the assembly plate 24. It should be noted that the assembly plate 24 is not flush with the top sides of the longitudinal profile members 14, 16 but is displaced by small amounts downwardly and outwardly, that is to say projecting beyond the ends of the longitudinal profile members 14, 16. In this case the head profile member 20 is an angle profile member in which the perpendicular limb becomes wider towards the center. It has a clamping slot 30 in the proximity of and parallel to its edge. Here and in the following FIGS. the desk frame at its other end is of an identical or mirror-image configuration, but that does not need to be discussed in greater detail here for simplification purposes.

Figure 4:
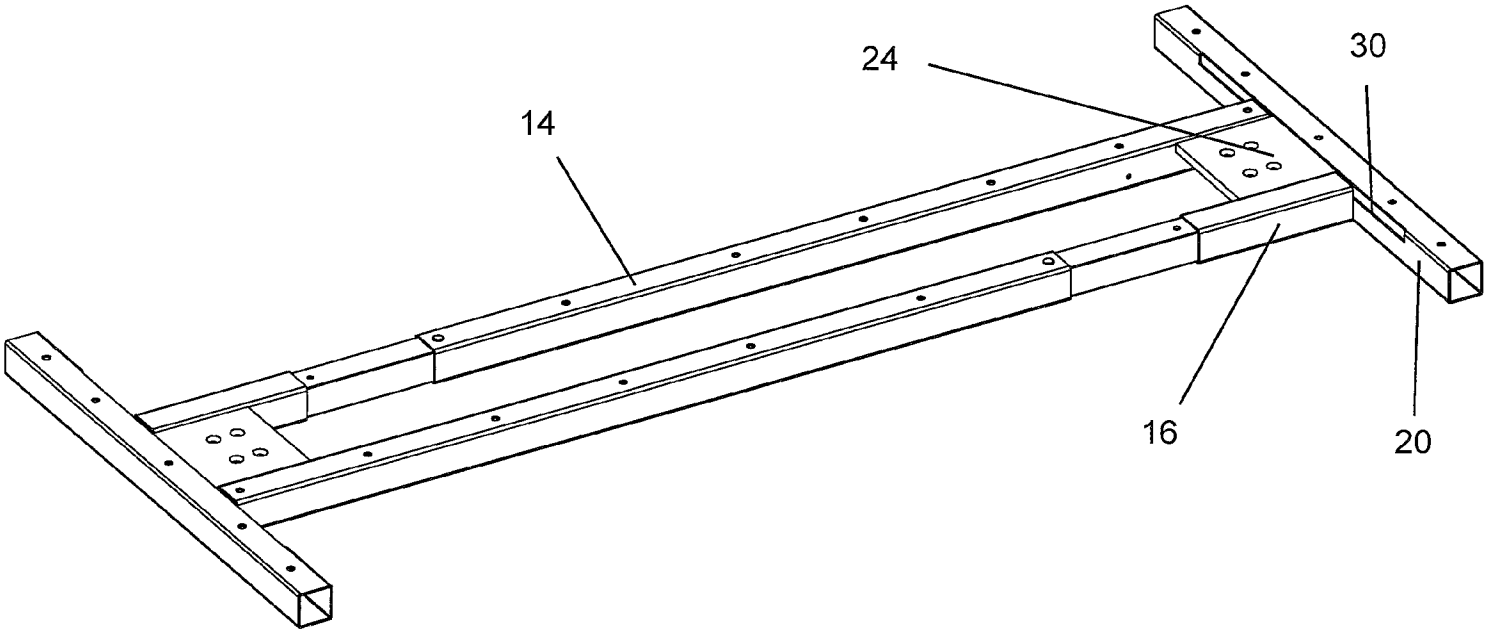

FIG. 4 shows a similar embodiment in the assembled condition, wherein the projecting edge of the assembly plate 24 is introduced into the clamping slot 30. In order now to connect the frame to the lift column which is operatively disposed below the assembly plate 24 and the desk top above it screws are passed through the four fixing holes on the lift column and in the assembly plate 24 and screwed into the desk top. Those screws now secure the assembly plate to the desk top. In that case the head profile member 20 is also clamped fast between the assembly plate 24 and the desk top.

Figure 5:
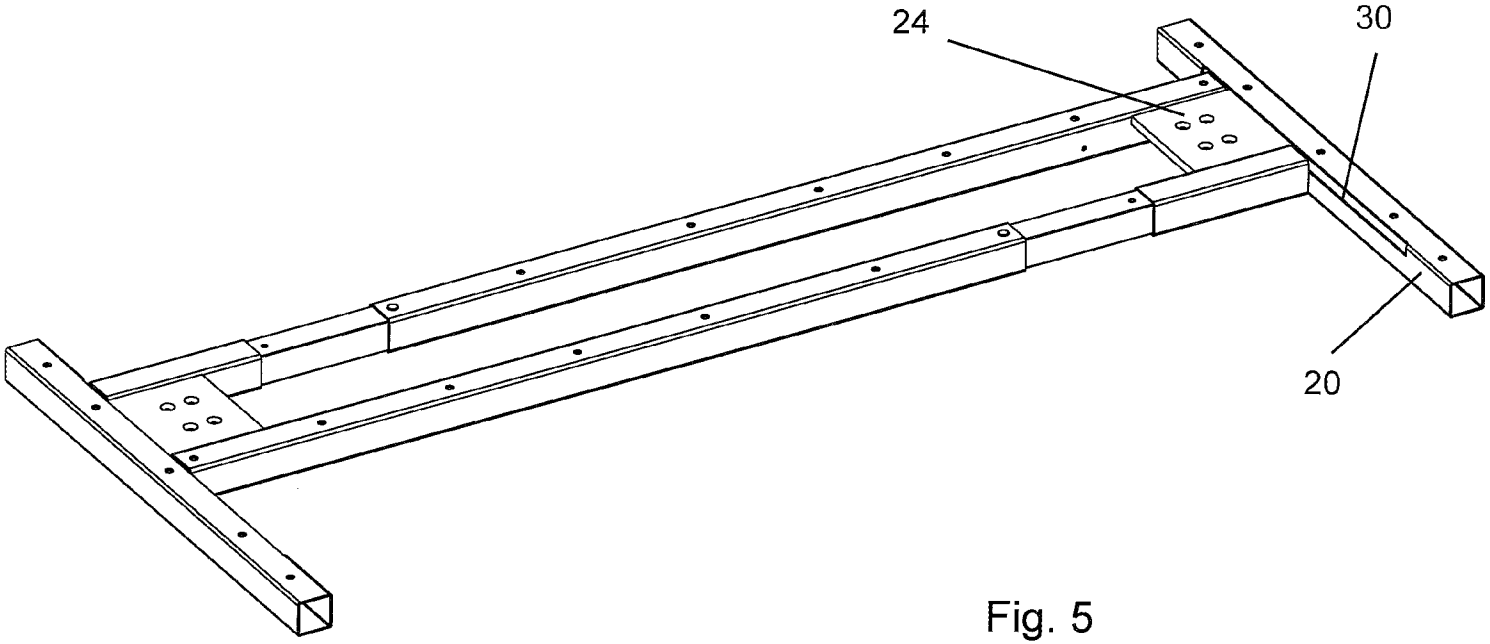

FIG. 5 shows the same embodiment in a modified assembly situation. Here the assembly plate 24 is displaced to the end of the clamping slot 30. If now the head profile member is fixed symmetrically on the underside of the desk top, the lift column is no longer aligned to the longitudinal center line of the desk top. Such an embodiment also generally requires the table leg to be of a correspondingly asymmetrical configuration, at the lower end of the lift column.

The subject-matter of the present invention arises not just from the subject-matter of the individual claims but from the combination of the individual claims with each other. All details and features disclosed in the documents—including the Abstract—, in particular the spatial configuration shown in the drawings, are claimed as essential to the invention insofar as they are novel individually or in combination in relation to the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

LIST OF REFERENCES

2 telescopic table or desk frame
4 short table or desk top
6 leg
8 leg
10 control box
12 long table or desk top
14 longitudinal profile member
16 longitudinal profile member
18 head profile member
20 head profile member
22 assembly plate

24 assembly plate
26 insert profile member
28 insert profile member
30 clamping slot

I claim:

1. A table or desk frame for supporting a top of a table or desk at a working height, which is designed for fixing table or desk legs, the frame comprising:

two opposing transverse members configured to be connected together by a plurality of longitudinal profile members to form a closed frame, the longitudinal profile members having respective top sides defining a support surface for supporting the top of the table or desk and the transverse members being located at opposing face ends of the longitudinal profile members, and the frame having a length defined along a longitudinal axis, the plurality of longitudinal profile members being oriented along the longitudinal axis and including at least one receiving profile member and a corresponding at least one insert profile member, wherein the receiving profile member is configured to telescopically receive the corresponding insert profile member along the longitudinal axis, the insert profile member being telescopically adjustable in the receiving profile member to adjust the length of the frame, an assembly plate configured to mount the table or desk leg, the assembly plate being located within the frame proximate one of the transverse members, wherein at least one of the transverse members includes a clamping slot and the assembly plate includes an edge projecting along the longitudinal axis beyond the face ends of the longitudinal profile members and into the clamping slot, and fixing means to both fix the frame to the table or desk top, and fix the at least one receiving profile member relative to the corresponding at least one insert profile member in a desired target position.

2. The frame according to claim 1, wherein the fixing means comprises fixing screws, and wherein each of the at least one receiving profile member and the at least one insert profile member includes a plurality of correspondingly arranged holes through which the fixing screws in aligned relationship can be passed and connected to an underside of the table or desk top.

3. The frame according to claim 1, wherein the longitudinally adjustable profile members are adjustable in a mutually displaced relationship.

4. The frame according to claim 1, wherein the transverse members are also adjustable in length.

5. The frame according to claim 1, wherein the frame is adjustable between a contracted configuration, in which the at least one insert profile member is received within the receiving profile member and the fixing means are spaced a first distance apart, and an expanded configuration, in which the at least one insert profile member is telescopically extended from the receiving profile member and the fixing means are spaced a second distance apart, the second distance being greater than the first distance.

* * * * *